United States Patent [19]

Palmer

[11] 4,453,499

[45] Jun. 12, 1984

[54] SYSTEM AND METHOD FOR REDUCING SCALE FORMATION IN BOILERS

[76] Inventor: James K. Palmer, 134 Fel Mar Dr., San Luis Obispo, Calif. 93401

[21] Appl. No.: 371,069

[22] Filed: Apr. 23, 1982

[51] Int. Cl.[3] ..... F22B 37/54; G01R 27/02

[52] U.S. Cl. ..... 122/379; 324/65 R; 324/65 CR; 122/396

[58] Field of Search ..... 122/379, 396, 398, 401; 324/65 R, 65 CR

[56] References Cited

U.S. PATENT DOCUMENTS

| | | | |
|---|---|---|---|
| 1,200,324 | 10/1916 | Earl et al. | 122/401 |
| 1,543,727 | 6/1925 | Spangent et al. | 122/396 |
| 2,597,597 | 5/1952 | Rice | 122/382 |
| 4,030,028 | 6/1977 | Allender | 324/65 R |
| 4,071,823 | 1/1978 | Okayama | 324/65 R |
| 4,087,742 | 5/1978 | Khoo | 324/65 CR |
| 4,184,952 | 1/1980 | Stewart | 324/65 R |
| 4,285,302 | 8/1981 | Kelly | 122/396 |

FOREIGN PATENT DOCUMENTS

| | | | |
|---|---|---|---|
| 1103424 | 2/1968 | United Kingdom . | |
| 1201362 | 8/1970 | United Kingdom . | |
| 779734 | 11/1980 | U.S.S.R. | 122/396 |

OTHER PUBLICATIONS

Mogul Solutrol B Brochure (2 pages) by The Mogul Corp., 1981.

*Primary Examiner*—Henry C Yuen

*Attorney, Agent, or Firm*—Daniel C. McKown

[57] ABSTRACT

A system and a method for controlling the concentration of dissolved matter in a liquid in a boiler or still, wherein a first sensor measures the electrical conductivity of the incoming liquid and a second sensor measures the electrical conductivity of the liquid in the boiler or still. The measured conductivities are then compared and a signal is generated which represents the relation of the conductivities. This signal is, in turn, compared with a preset value and the difference is used to control the flow of incoming liquid which serves to dilute the liquid in the boiler.

19 Claims, 2 Drawing Figures

SYSTEM AND METHOD FOR REDUCING SCALE FORMATION IN BOILERS

BACKGROUND OF THE INVENTION

1. Field of the Invention

The present invention is in the field of steam generation and more specifically relates to to a system and a method applicable to boilers, stills and like apparatus, for controlling the formation of scale therein.

2. The Prior Art

The problem of scale formation on the inside of a boiler and related pipes is encountered whenever large quantities of steam are to be produced from a supply of water that contains dissolved solids. Typically, to control the formation of scale, such boilers are operated in such a manner that for each 100 parts by weight of incoming water, 80 parts are converted to steam while the remaining 20 parts are discharged from the boiler as waste water. The concentration of dissolved solids in the discharged waste water is much greater than in the incoming water, and to a large extent, the dissolved solids are discharged with the waste water, in an effort to reduce the formation of scale within the boiler.

The 80-20 ratio is chosen to allow a margin of safety, because if the boiler should ever run dry, all of the dissolved solids would be deposited on the inside of the boiler and associated pipes, thereby clogging the pipes and reducing the transfer of heat to the liquid. From the standpoint of energy conservation, it would be desirable to discharge less than the typical 20 percent of the heated water if this could be accomplished without the risk of the boiler running dry. That is, a 90-10, or even 95-5 ratio would save an appreciable amount of energy if the risk of the boiler going dry could be avoided.

Another consideration is that the solubility of most of the typical dissolved compounds increases with increasing temperature. As water from the boiler is conducted through various pipes to the point of discharge, the water typically becomes cooler with the result that some of the dissolved compounds may be forced to come out of solution and deposit on the various pipes. This particular problem is relieved by diluting the liquid in the boiler, to avoid discharging such a highly concentrated solution. However, the concentration of dissolved matter in the boiler water is rarely measured, and in practice the problem is attacked by operating the boiler at an 80-20 ratio, for example. If the concentration of material in the incoming liquid is not very great, then the choice of an arbitrary operating ratio, such as 80-20, may be needlessly inefficient if, in fact, no problems would be encountered even if a 95-5 ratio were employed.

The present invention provides a method and system for accurately determining the concentration of dissolved matter in the boiler water, and this makes possible more efficient modes of operation.

Perhaps the most common technique employed in the prior art is for a technician to manually open a valve to collect a sample of the incoming liquid in a small container. The technician also draws a small sample of the liquid in the boiler into a different container. Thereafter, the concentration of dissolved matter in both samples is determined, and based on the results, the liquid in the boiler may be diluted.

This approach has several disadvantages. It requires the intervention of a human operator, it does not provide a continuous monitoring of the concentrations, and typically there is a moderate time lag between when the samples are taken and when the corrective action is taken. It is an object of the present invention to overcome these shortcomings of the manual method.

The present invention must be distinguished from a device known in the art as the MOGUL SOLUTROL B® which is manufactured by the Mogul Corporation of Chagrin Falls, Ohio. That device periodically samples the boiler water, and if the conductivity of the boiler water exceeds a predetermined level, the water in the boiler will be diluted under control of the device. Unlike the present invention, the Mogul device does not provide continuous sampling, and it responds only to the conductivity of the boiler water, without regard to the conductivity of the incoming water. Accordingly, it cannot be used to implement a control technique based on the ratio of the concentrations of dissolved solids. In contrast, the system of the present invention measures the conductivity of both the incoming water and the water discharged from the boiler, thereby enabling a control scheme based on the ratio of the concentrations. Also, the system of the present invention employs a continuous sampling of the concentrations.

SUMMARY OF THE INVENTION

The present invention employs a first sensor to measure the conductivity of the incoming liquid and a second sensor for measuring the conductivity of the liquid in the boiler. The measured conductivities are compared in a comparator and if the conductivity of the liquid in the boiler is excessive relative to the conductivity of the incoming liquid, the comparator causes the liquid in the boiler to be diluted by the addition of incoming liquid. In a preferred embodiment, the sensing and comparing functions are executed continuously and autonomously, that is, without the intervention of a human operator.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

The system of the present invention is particularly well adapted for use in situations where a liquid solution is concentrated by boiling off some of the solvent until the concentration of the solute has been increased by a chosen percentage or multiple. The liquid may be processed either in batches or on a continuous flow basis.

Figure 1:
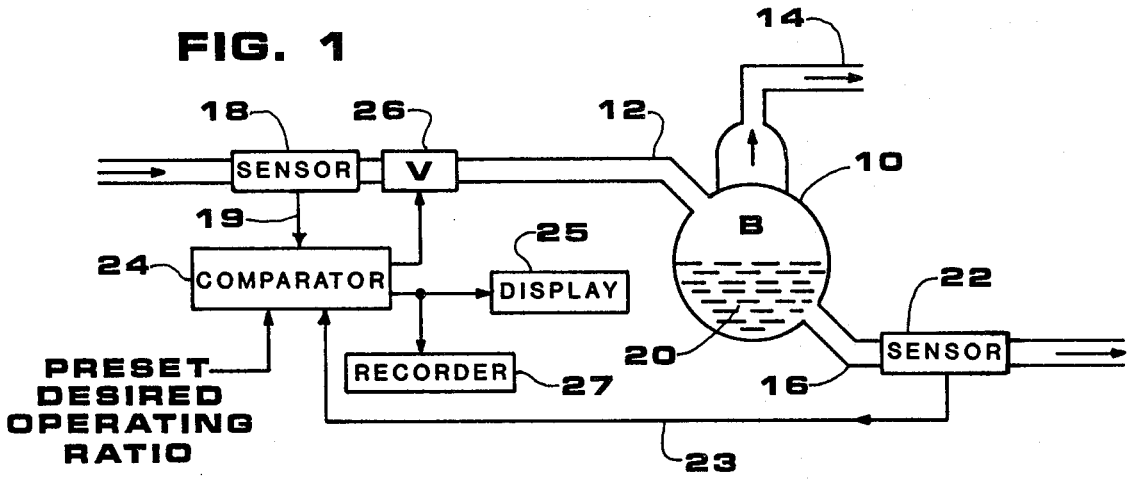
FIG. 1 is a diagram illustrating a preferred embodiment of the present invention; and, FIG. 2 is a flow chart of the method of the present invention.

The diagram of FIG. 1 shows the system of the present invention applied to a water boiler. The pipe 12 conducts incoming water to the boiler 10, and the steam produced is conducted from the boiler through the pipe 14. The pipe 16 is used for discharging water from the boiler.

In accordance with a preferred embodiment of the present invention, a first conductivity sensor 18 is used to sense the electrical conductivity of the incoming water. The first sensor 18 produces an electrical signal on the conductor 19 that is representative of the electrical conductivity of the incoming water.

Similarly, a second conductivity sensor 22 senses the electrical conductivity of the water 20 in the boiler 10 and produces an electrical signal on the line 23 that is representative of the electrical conductivity of the water in the boiler.

The electrical signals on the conductors 19, 23 are applied to the comparator 24 which determines the ratio of the conductivity of the water in the boiler to the conductivity of the incoming water. This ratio is expressed electrically by the controller 24 in the form of a signal that is applied to the display device 25.

In a preferred embodiment, the comparator 24 includes an amplifier in a feedback circuit which determines how many times the signal on the conductor 19 must be multiplied so that the difference between the multiplied signal and the signal on the conductor 23 equals zero. To the extent that the steam contains no dissolved solids, i.e., to a very close approximation, the multiple thus found equals the steam-to-concentrate ratio discussed above. The multiple thus found is recorded on the recorder 27 to provide a permanent continuous record of the steam-to-concentrate ratio. The multiple is also applied to the display 25 to facilitate an instantaneous visual monitoring of the state of the boiler.

The multiple thus found is compared in the comparator 24 with a preset desired operating ratio, and the difference is applied to an electrically controlled valve 26 for controlling the flow of incoming water through the pipe 12.

In an alternative embodiment the comparator determines the difference, instead of the ratio, between the signal on the conductor 23 and the signal on the conductor 19, i.e., the difference between the conductivity of the water in the boiler and the conductivity of the incoming water. In the alternative embodiment this difference is then compared to a preset quantity and the deviation between the difference and the preset quantity is applied to the display 25 and to the electrically controlled valve 26.

In accordance with the preferred embodiment of the present invention, the sensors 18, 22 and the comparator 24 operate continuously to provide instantaneous control of the concentration of dissolved matter in the water 20 in the boiler 10. It is seen that the sensing, comparing and controlling operations are carried out without the need for human intervention, i.e., autonomously.

It can be further seen that the sensing, comparing, monitoring and controlling operations can be carried out without the need for special chemicals, reagents or fluids as expendable or depletable reactants which are commonly used in spectrophotometers, calorimeters or liquid chromatographs.

Figure 2:
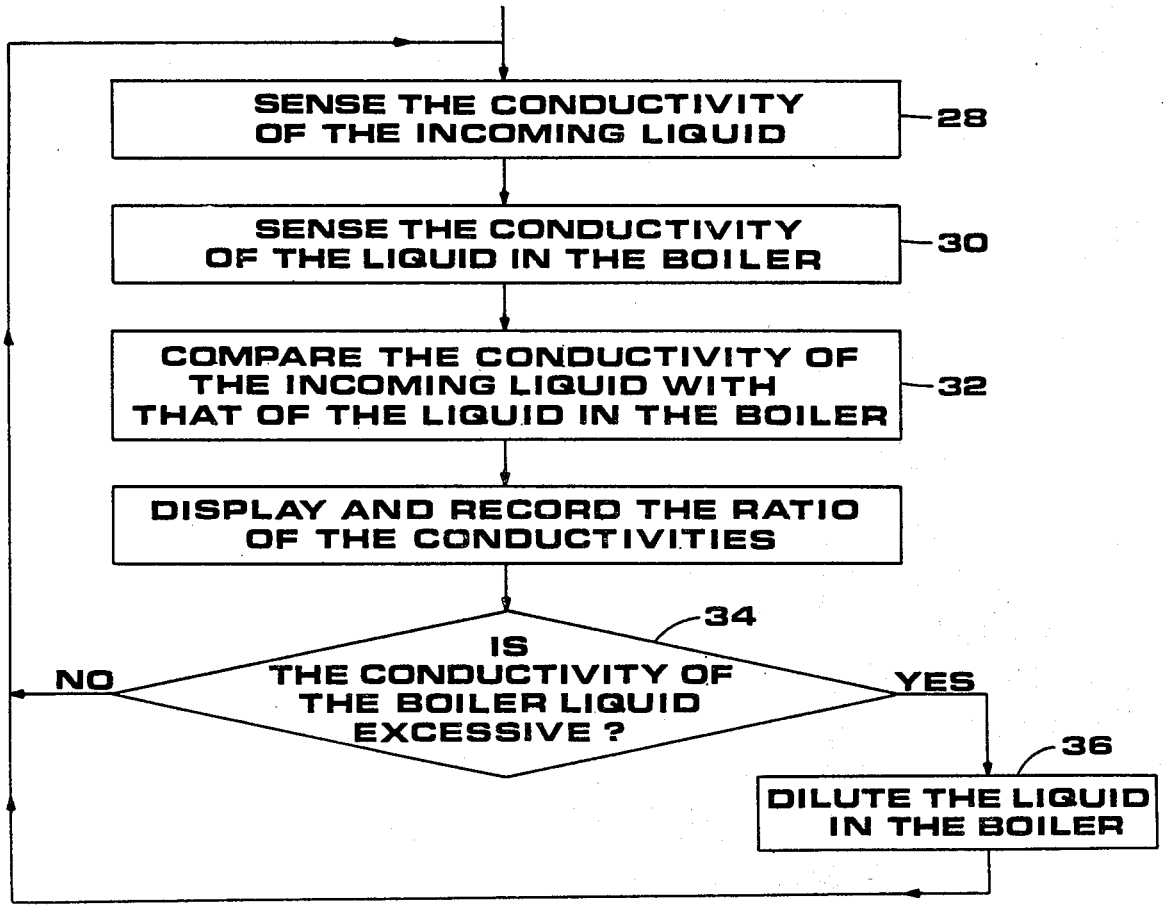

FIG. 2 is a flow diagram showing a preferred embodiment of the method of the present invention. In a first step 28, the conductivity of the incoming liquid is sensed. In the next step 30 of the method, the conductivity of the liquid in the boiler is sensed.

The conductivity of the liquid in the boiler is compared in the step 32 with the conductivity of the incoming liquid. At the step 34, a decision is made regarding further the conductivity of the liquid in the boiler is excessive. If the conductivity of the liquid in the boiler is found to be excessive, the liquid in the boiler is diluted as indicated by the step 36. If the conductivity of the liquid in the boiler is not excessive, then no action is taken. Regardless of the decision reached, the process is repeated. In accordance with the preferred embodiment, the process may be considered to be repeated at such a high frequency as to be continuous. Also, the steps 28 and 30 are interchanged in an alternative embodiment of the method.

Thus, there has been described a system and a method for controlling the degree of concentration of a solution that is being boiled or otherwise concentrated, so that the concentration of the liquid in the boiler will be maintained at a particular relationship to the conductivity of the incoming liquid.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A method for reducing scale formation in boilers, stills, or other apparatus in which an incoming liquid is concentrated, said method comprising the steps of:
   (a) sensing the conductivity of the incoming liquid autonomously;
   (b) sensing the conductivity of the liquid in the boiler autonomously;
   (c) comparing the conductivity of the liquid in the boiler with the conductivity of the incoming liquid to determine whether the conductivity of the liquid in the boiler is excessive.

2. The method of claim 1 wherein step (b) further comprises removing some of the liquid from the boiler.

3. The method of claim 1 wherein steps (a), (b) and (c) are performed continuously.

4. The method of claim 1 wherein step (c) is performed autonomously.

5. The method of claim 1 wherein step (c) further includes determining the ratio of the conductivity of the liquid in the boiler to the conductivity of the incoming liquid.

6. The method of claim 5 further comprising the step of recording the determined ratio.

7. The method of claim 5 further comprising the step of displaying the determined ratio.

8. The method of claim 1 wherein step (c) further includes determining the difference between the conductivity of the liquid in the boiler and the conductivity of the incoming liquid.

9. The method of claim 8 further comprising the step of recording the determined difference.

10. The method of claim 8 further comprising the step of displaying the determined difference.

11. The method of claim 1 further comprising the subsequent step of diluting the liquid in the boiler by adding more of the incoming liquid when the conductivity of the liquid in the boiler is excessive relative to the conductivity of the incoming liquid.

12. Apparatus for reducing scale formation in a boiler in which an incoming liquid is concentrated, comprising in combination:

first sensing means for sensing the conductivity of the incoming liquid autonomously and for producing a first electrical signal representing the conductivity of the incoming liquid;

second sensing means for sensing the conductivity of the liquid in the boiler autonomously and for producing a second electrical signal representing the conductivity of the liquid in the boiler;

comparing means connected to said first sensing means and to said second sensing means and receiving from them respectively said first electrical signal and said second electrical signal, for comparing the conductivity of the liquid in the boiler with the conductivity of the incoming liquid to determine whether the conductivity of the liquid in the boiler is excessive.

13. The apparatus of claim 12 wherein said comparing means determines the ratio of the conductivity of the liquid in the boiler to the conductivity of the incoming liquid.

14. The apparatus of claim 13 further comprising recording means for recording the determined ratio.

15. The apparatus of claim 13 further comprising display means for displaying the determined ratio.

16. The apparatus of claim 12 wherein said comparing means determines the difference between the conductivity of the liquid in the boiler and the conductivity of the incoming liquid.

17. The apparatus of claim 16 further comprising recording means for recording the determined difference.

18. The apparatus of claim 16 further comprising display means for displaying the determined difference.

19. The apparatus of claim 12 further comprising:

means connected to said comparing means for diluting under control of said comparing means the liquid in the boiler when the conductivity of the liquid in the boiler is excessive.

* * * * *